US007743948B2

(12) United States Patent
Drennow

(10) Patent No.: US 7,743,948 B2
(45) Date of Patent: Jun. 29, 2010

(54) DISPENSING DEVICE

(76) Inventor: Sten Drennow, Ostervàngevägen 4, S-224 60 : Lund (SE)

( * ) Notice: Subject to any disclaimer, the term of this patent is extended or adjusted under 35 U.S.C. 154(b) by 1050 days.

(21) Appl. No.: 10/582,753

(22) PCT Filed: Dec. 20, 2004

(86) PCT No.: PCT/SE2004/001916

§ 371 (c)(1),
(2), (4) Date: Jun. 14, 2006

(87) PCT Pub. No.: WO2005/061366

PCT Pub. Date: Jul. 7, 2005

(65) Prior Publication Data

US 2007/0158364 A1 Jul. 12, 2007

(30) Foreign Application Priority Data

Dec. 22, 2003 (SE) ..... 0303455

(51) Int. Cl.
*B65D 37/00* (2006.01)

(52) U.S. Cl. ..... 222/207; 222/209; 222/210; 222/212; 222/214; 222/380; 222/381; 222/324; 222/472; 417/479; 92/96

(58) Field of Classification Search ..... 222/207, 222/209, 210, 212–214, 372, 377, 380, 381, 222/323, 324, 441, 469, 470, 472, 473; 417/479, 417/480, 413.1; 92/96, 98 R; 401/158, 161, 401/163, 165–167
See application file for complete search history.

(56) References Cited

U.S. PATENT DOCUMENTS 2,435,527 A * 2/1948 Arpin ..... 222/79
5,452,826 A 9/1995 Stern
2002/0125271 A1* 9/2002 Zeitlin ..... 222/181.3

FOREIGN PATENT DOCUMENTS

DE 39 14 518 A1 1/1991

* cited by examiner

*Primary Examiner*—J. Casimer Jacyna
(74) *Attorney, Agent, or Firm*—Tarolli, Sundheim, Covell & Tummino LLP

(57) ABSTRACT

The present invention relates to a dispensing device for dispensing a liquid or viscous substance, preferably foodstuff. At least one pump means (4) is provided to perform pump motions for sucking said substance (2) into the dispensing device (1) and dispense or discharge it therefrom. The pump means (4) is provided to divide inner parts of the dispensing device (1) into at least one suction chamber (30) and at least one dispensing or discharge chamber (31) which are interconnected through at least one transfer chamber (32). The pump means (4) is during a first pump motion in one direction (A) provided to suck substance (2) into the suction chamber (30) and simultaneously dispense or discharge substance (2) from the discharge chamber (31). The pump means (4) is during a second pump motion in the opposite direction (D) relative to the first pump motion provided to feed substance (2) from the suction chamber (30) and through the transfer chamber (32) into the discharge chamber (31).

21 Claims, 4 Drawing Sheets

DISPENSING DEVICE

This application is a national stage entry of application PCT/SE04/01916, with an international filing date of Dec. 20, 2004.

FIELD OF THE INVENTION

The present invention relates to a dispensing device for dispensing a liquid or viscous substance, preferably foodstuff, wherein at least one pump means is provided to perform pump motions for sucking said substance into the dispensing device and dispense or discharge it therefrom.

BACKGROUND OF THE INVENTION

Dispensing devices for dispensing or discharging viscous foodstuff are known from U.S. Pat. No. 5,452,826. Such dispensing devices comprise a pump means which during a pump stroke sucks foodstuff out of an inner container and which during a reversed pump stroke discharges foodstuff.

Such a dispensing device has a limited pump speed, because after every discharge or outfeed one has to wait until the pump means has refilled the pump chamber.

SUMMARY OF THE INVENTION

The object of the present invention is to provide a dispensing device permitting a higher pump speed than what previously has been possible to reach at similar dispensing devices. This is arrived at according to the invention by providing it with the characterizing features of subsequent claim 1.

Since the dispensing device according to the invention during a return movement of the pump means transfers the substance from a suction chamber to a dispensing chamber, the dispensing or discharging speed may be substantially increased, which might be a great advantage when the dispensing device is used on stressy occations in e.g. snack bars, restaurants or similar.

BRIEF DESCRIPTION OF THE DRAWINGS

The invention will be further described below with reference to the accompanying drawings, in which.

DESCRIPTION OF EXAMPLE EMBODIMENTS

Figure 1:
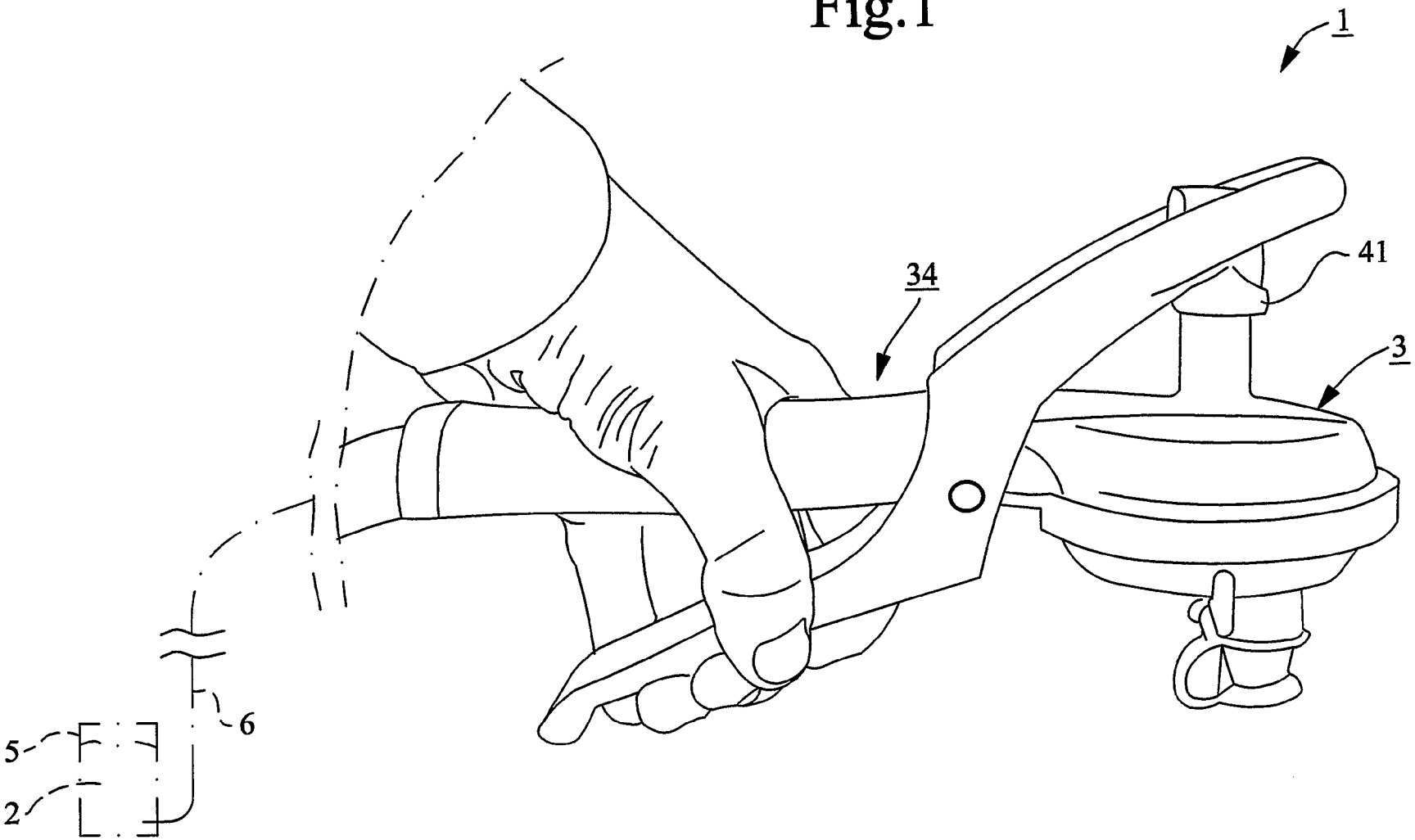
FIG. 1 is a perspective view of a dispensing device according to the invention.
Figure 2:
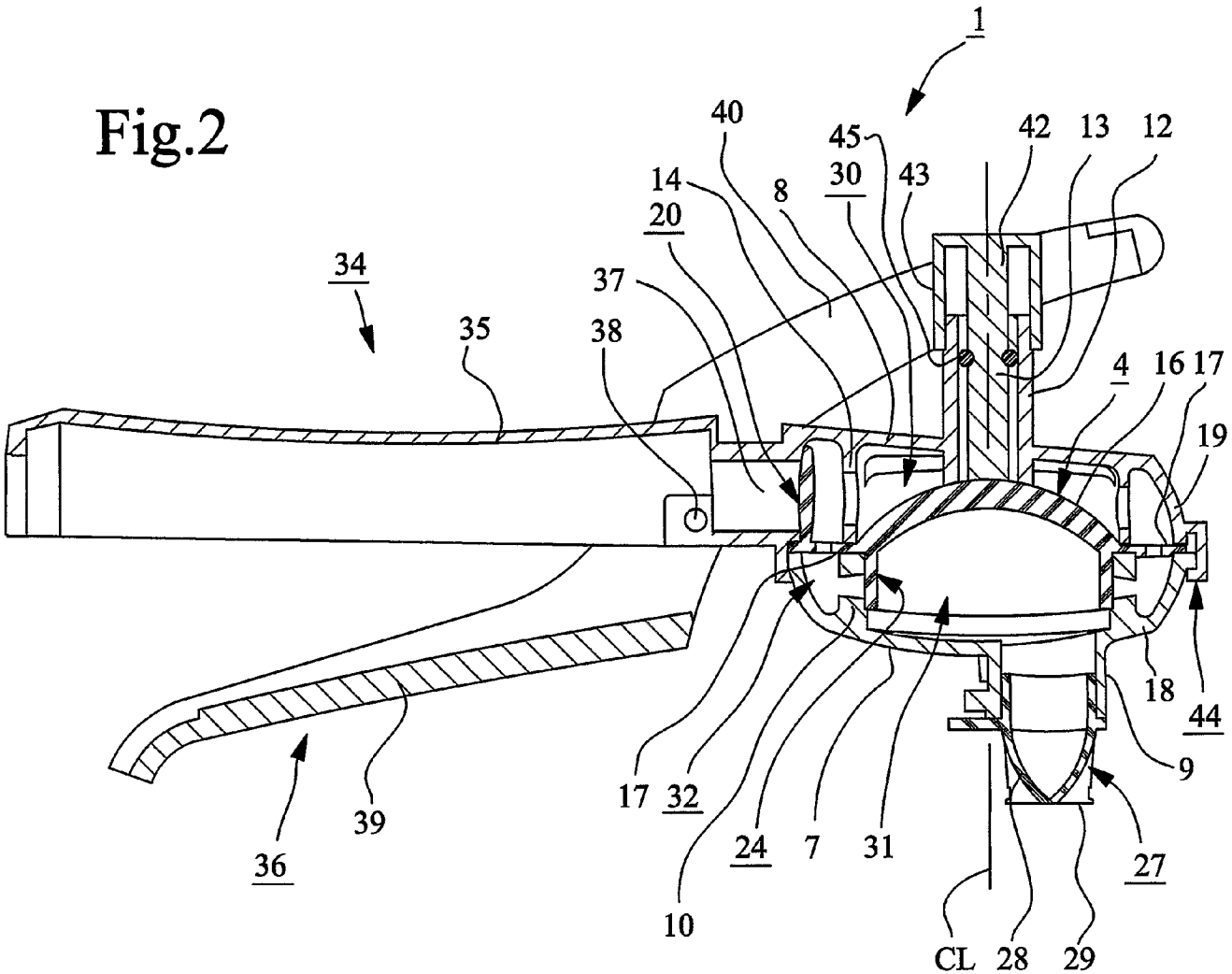
FIG. 2 is a sectional view of the dispensing device of FIG. 1.

The dispensing device 1 illustrated in the drawings is adapted for dispensing or discharging a liquid or semi-liquid substance 2 and comprises a dispensing or discharge housing 3 with a pump means 4. The pump means is provided to perform pump motions for sucking substance 2 out of a container 5 and through a hose 6 or a similar conduit to the discharge housing 3, and for dispensing or discharging the substance 2 in the discharge housing 3 from said housing.

The liquid or viscous substance 2 may be foodstuff, e.g. mustard, ketchup, mayonnaise, dressing, cooking oil or similar and said foodstuff may be dispensed or fed out onto a dish, e.g. a hamburger or similar.

At the embodiment shown, the discharge housing 3 has a lower member 7 and an upper member 8 which are both substantially cup shaped. The pump means 4 may be located between the lower and upper members 7, 8, where-after said members may be interconnected to a discharge housing 3 which is tight between the lower and upper members 7, 8 while the pump means 4 define a sealing there-between.

The lower member 7 has a downwardly directed dispensing or discharge pipe 9 and an upwardly directed wall 10 which is annular, extends around and is preferably centered with an imaginary geometric centre line CL through the discharge housing 3. The wall 10 has at least one substance transfer opening 11 and preferably includes several such openings distributed around the centre line CL. The discharge pipe 9 may be eccentrically located relative to the centre line CL.

The upper member 8 has an upwardly directed sleeve 12 in which a piston means 13 is displaceably mounted and it also has a downwardly directed wall 14 of annular shape, extending around and preferably centered with the centre line CL. The wall 14 has at least one through-flow opening 15 for substance 2 and it has preferably the same diameter as the wall 10.

The pump means 4 consists entirely or at least substantially of elastic material and includes an elastic dome shaped member 16 housed within the downwardly directed wall 14 of the upper member 8. The dome shaped member 16 has a radially outwardly directed flange 17 which extends out between the walls 10 and 14 and in between outer walls 18, 19 of the up- and downwardly directed walls 10, 14 of the dispensing or discharge housing 3, such that outer parts of the flange 17 provide a sealing between said outer walls 18, 19.

On the flange 17, at the outer periphery thereof, there is provided a valve body 21 for a first non-return valve 20 and this valve body 21 consists preferably of an elastic tongue. This tongue cooperates with a valve seat 22 which is designed as an edge around a substance inlet opening 23 through which substance 2 can be sucked into the discharge housing 3.

The first valve body 21 designed as a tongue can be brought to leave the valve seat 22 during suction of substance 2 into the discharge housing 3 and it can there-after automatically return to engagement with the valve seat 22 for closing the substance inlet opening 23.

The pump means 4 further comprises a second non-return valve 24 having at least one valve body 25 which may be one or more members or designed as a downwardly directed sleeve. This valve body extends from peripheral parts of the dome shaped member 16 and is directed down into the lower member 7 immediately within its upwardly directed wall 10 and the substance transfer openings 11 therein. The edges around the substance transfer openings 11 define valve seats 26 for the valve body 25 and said valve body is provided to be brought to leave said valve seats 26 to let through substance 2 through said openings 11, and it may automatically return to its cooperation with the valve seats 26 for closing the substance transfer openings 11.

On the dispensing or discharge pipe 9 there may be provided a third non-return valve 27 which is provided to close said discharge pipe 9, but which can be opened by substance 2 pressing thereagainst for letting out said substance from the discharge housing 3. The third non-return valve 27 may be adapted to prevent substance 2 from dripping from the dispensing or discharge housing 3 and it may consist of a hose member 28 which is inserted into or eventually threaded onto the discharge pipe 9 and which has a closed outer end 29. This outer end 29 can be opened by substance 2 pressing thereagainst and it may automatically return to the closed shape when the pressure from the substance 2 ceases.

Figure 3:
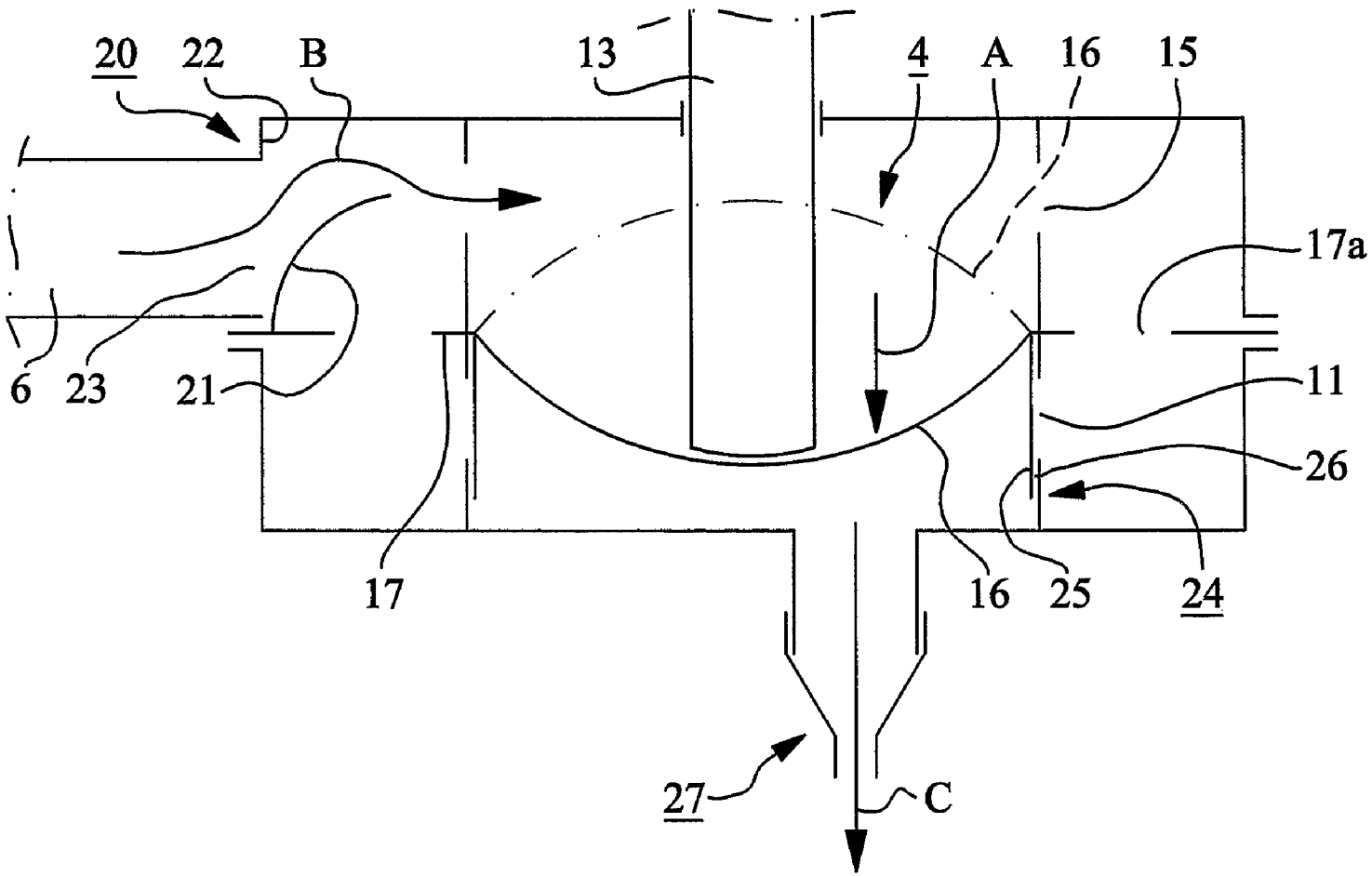
FIGS. 3 and 4 illustrate schematically how the dispensing device of FIGS. 1 and 2 operates at different pump strokes.
Figure 4:
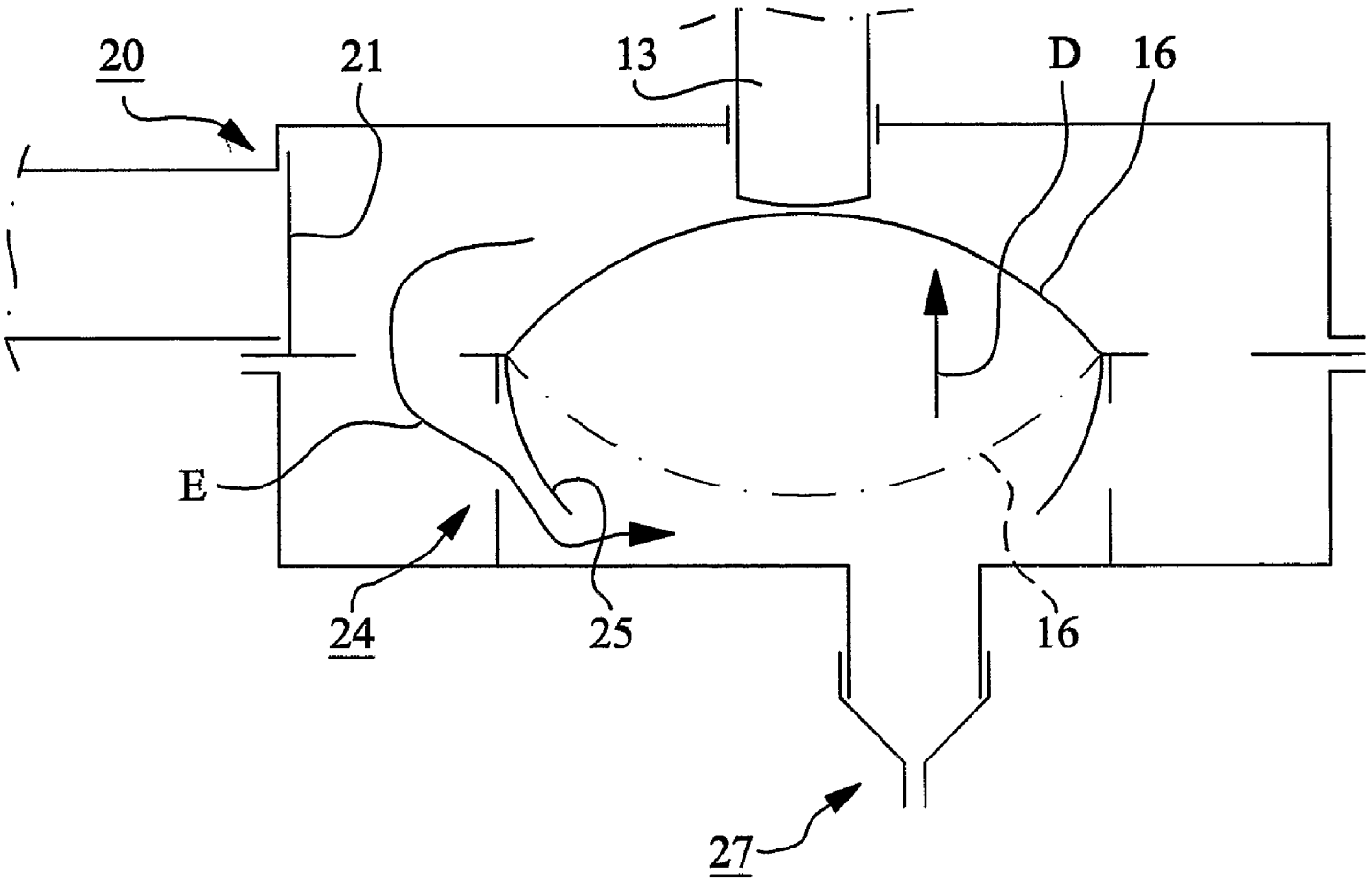

The pump means 4 is provided to divide the inner parts of the dispensing device 1 into at least one suction chamber 30 and at least one dispensing or discharge chamber 31, which are interconnected through at least one transfer chamber 32. The pump means 4 is during a first pump motion in a direction A, during which the dome shaped member 16 is pressed from a position in the upper member 8 to a lower position in the lower member 7, provided to suck substance 2 into the suction chamber 30 (arrow B, FIG. 3) and at the same time discharge substance 2 from the discharge chamber 31 (arrow C, FIG. 3). The pump means 4 is also provided to perform a second pump motion in the opposite direction D (FIG. 4) relative to the first pump motion in direction A. This second pump motion in direction D is reached while the dome shaped member 16 automatically returns from its position in the lower member 7 to its position in the upper member 8. During this second pump motion in direction D of the pump means 4, substance 2 is fed from the suction chamber 30 and through the transfer chamber 32 into the dispensing or discharge chamber 31 (arrow E, FIG. 4).

In order to permit substance 2 to flow through the transfer chamber 32, the flange 17 extending across said chamber is provided with holes 17*a* through which substance 2 may pass.

During the first pump motion in direction A of the pump means 4, the first non-return valve 20 is opened such that substance 2 may be sucked from the container 5 through the hose 6 or similar to the substance inlet opening 23 and therethrough into the suction chamber 30. At the same time, the second non-return valve 24 is closed and substance 2 is discharged from the discharge chamber 31 through the third non-return valve 27. During the movement in the opposite direction D of the pump means 4, the first non-return valve 20 is closed and substance 2 is pressed by the pump means 4 out of the suction chamber 30 and into the transfer chamber 32 such that the second non-return valve 24 is opened, whereby this substance 2 can be brought to flow into the discharge chamber 31. If there is a third non-return valve 27, this valve prevents air from being sucked into the discharge chamber 31 through the discharge pipe 9. This pump operation can be repeated until desired amounts of substance 2 have been pumped out to the desired number of products or locations.

The dispensing device 1 is preferably designed as a hand pump which can be held in one hand while at the same time pumping is carried through therewith, if necessary also with the other hand. The hand pump may comprise a handle 34 consisting of a first and a second handle member 35 and 36, whereby the first handle member 35 is rigidly connected with the upper member 8 of the dispensing or discharge housing 3 and preferably made integral therewith. The first handle member 35 may at least partly have a semicircular cross section such that one can locate parts of the hose 6 therein. Closest to the upper member 8, the handle member 35 may have a connection member 37 for tight connection of the end of the hose 6 to the upper member 8 such that the hose 6 communicates with the suction chamber 30.

The second handle member 36 is mounted on the first handle member 35 pivotable about an axis 38 such that it defines a lever with two shanks 39, 40 of which a first shank 39 can be held in one hand along with the first handle member 35 and be pressed up towards said first handle member 35 in order to perform pump motions. The second shank 40 pivot downwards when the first shank 39 is pressed upwards. The second shank 40 is provided to transfer said downward pivoting movement to the pump means 4 by cooperating with the piston means 13 for pressing it downwards and it may be bifurcated for cooperation with two flanges 41 which protrude in opposite directions from upper parts 42 of the piston means 13.

If it is heavy to perform a discharge or an outfeed with one hand by pressing the first shank 39 of the second handle member 36 upwards, one can use the other hand to press the second shank 40 downwards.

In order to provide sealing between the sleeve 12 and the piston means 13, there may beta sealing means 45 between said members which may consist of a sealing ring which is threaded onto the piston means.

Upper parts 42 of the piston means 13 may be situated above the sleeve 12 and they may include a downwardly directed pipe member 43 which is closed at the top. An inner wall of this pipe member 43 may cooperate displaceably with an outer wall of the sleeve 12.

The piston means 13 can be completely removed from the sleeve 12 for separate cleaning thereof.

For quick and easy assembly of the lower and upper members 7, 8 and quick and easy disassembly thereof, said members may have portions defining a bayonet mount or coupling 44. This bayonet mount 44 permits interconnection of the members 7, 8 by rotating one of said members relative to the other member in one direction, and disconnection by rotating said one member in the opposite direction.

The amount of substance 2 to be dispensed or discharged by means of the pump means 4 can be altered by replacing the piston means 13 with a piston means 13 having another length and/or diameter.

At a particularly simple embodiment which is also easy to clean, the dispensing device 1 may comprise only four members which are easy to assemble and disassemble, namely the lower and upper members 7 and 8, the pump means 4 and the piston means 13. After disassembly or disconnection of the members, said members may be cleaned separately and easily reassembled. Eventually, there may be a fifth, easily removable member, namely the third non-return valve 27, which may consist of a simple and loosenable or detachable hose member 28.

The container 5 may be a flexible container, e.g. a plastic bag, which is designed to collapse when substance 2 is sucked out therefrom.

The invention is not limited to what is described above and illustrated in the drawings, but may vary within the scope of the following claims. As alternatives not described one should mention that the third non-return valve 27 is not absolutely necessary, that there may be more than one dispensing or discharge pipe 9 or similar, that the pump means 4 may be designed in other ways and that eventually a distributing device may be connected to the dispensing or discharge housing 3 for distributing substance 2 to many locations, e.g. six or eight locations, during each discharge or outfeed.

The invention claimed is:

1. Dispensing device for dispensing or discharging a liquid or viscous substance (2) wherein:

at least one pump means (4) is provided to perform pump motions for sucking said substance (2) into the dispensing device (1) and dispense or discharge it therefrom, the pump means (4) comprises an elastic dome shaped member (16) which is provided to divide inner parts of the dispensing device (1) into at least one suction chamber (30) and at least one dispensing or discharge chamber (31) which are interconnected through at least one transfer chamber (32), the dome shaped member (16) is provided to be brought to perform a first pump motion in one direction (A) by being pressed or pushed inwards to suck substance (2)

into the suction chamber (30) and simultaneously dispense or discharge substance (2) from the discharge chamber (31), and the dome shaped member (16), when pressure ceases, performs a second pump motion in the opposite direction (D) relative to the first pump motion while said dome shaped member (16) automatically returns to its original dome shape, thereby feeding substance (2) from the suction chamber (30) and through the transfer chamber (32) into the discharge chamber (31).

2. Dispensing device according to claim 1, wherein:

at least one first non-return valve (20) is provided to open a substance inlet opening (23) through which substance (2) can be sucked into the suction chamber (30), but close said inlet opening (23) when substance (2) pass through the transfer chamber (32) into the discharge chamber (31), and at least one second non-return valve (24) is provided to open at least one substance transfer opening (11) through which substance (2) can be sucked into the discharge chamber (31), but close said transfer opening (11) when substance (2) is discharged from the discharge chamber (31).

3. Dispensing device according to claim 1, wherein the dome shaped member (16) has an elastic tongue which defines a valve body (21) for the first non-return valve (20) and at least one other elastic tongue which defines a valve body (25) for the second non-return valve (24).

4. Dispensing device according to claim 3, wherein the dome shaped member (16) and the valve bodies (21, 25) of the first and second non-return valves (20, 24) are made in one piece of elastic material.

5. Dispensing device according to claim 3, wherein:

the dome shaped member (16) is, at peripheral parts thereof, provided with a flange (17) which is radially directed relative to said dome shaped member, the valve body (21) of the first non-return valve (20) is located at peripheral parts of said flange (17) and is directed axially therefrom relative to the dome shaped member (16) such that said valve body (21) can cooperate with a valve seat (22) at a substance inlet opening (23) for letting substance (2) into the suction chamber (30), the valve body (25) of the second non-return valve (24) is located at the same peripheral parts of the dome shaped member (16) as the flange (17), and the valve body (25) of the second non-return valve (24) is axially directed relative to the dome shaped member (16) such that it will be situated within and can cooperate with at least one valve seat (26) at least one substance transfer opening (11) and defined by an upwardly directed wall (10) of the dispensing device (1).

6. Dispensing device according to claim 5, wherein:

the flange (17) of the dome shaped member (16) extends in between a lower and an upper member (7, 8) of the discharge housing (3), parts of the flange (17) situated in the transfer chamber (32) has at least one hole (17*a*) permitting substance (2) to flow through said transfer chamber (32) from the suction chamber (30) into the discharge chamber (31), and the dome shaped member (16) can be pressed downwards from an upper position in an upper member (8) of the dispensing device (1) to a lower position in a lower member (7) of said dispensing device (1) for sucking substance (2) into the suction chamber (30) and discharge or outfeed of substance (2) from the discharge chamber (31).

7. Dispensing device according to claim 1, wherein the dispensing device (1) is designed as a hand pump which can be held in one hand and operated therewith or with two hands for discharge or feedout of substance (2).

8. Dispensing device according to claim 7, wherein the dispensing device (1) comprises a handle (34) with a first and a second handle member (35, 36) such that said device (1) can be held in one hand and the pump means (4) operated by effecting the second handle member (36) with one or both hands for dispensing or discharging substance (2) from the dispensing device (1).

9. Dispensing device according to claim 8, wherein:

the second handle member (36) is pivotally mounted and designed as a lever with a first and a second shank (39, 40), and the first shank (39) can be brought to perform pump motions with the hand, said pump motions being transferred to the pump means (4) through the second shank (40).

10. Dispensing device according to claim 9, wherein the second shank (40) is designed such that it can be operated with the other hand for supporting the pump motions being brought to the first shank (39) by one hand.

11. Dispensing device according to claim 1, wherein the dispensing device (1) comprises a piston means (13) which is provided to bring the pump means (4) to perform pump motions, said piston means (13) being displaceabley mounted in a sleeve (12) which is located on a dispensing or discharge housing (3) forming part of the dispensing device (1) and through which the piston means (13) extends into said housing (3).

12. Dispensing device according to claim 11, wherein at least one sealing means (45) is provided to bring about a sealing between the piston means (13) and the sleeve (12).

13. Dispensing device according to claim 1, wherein:

at least one dispensing or discharge pipe (9) is provided for dispensing or discharging substance (2), a third non-return valve (27) is located on the discharge pipe (9), the third non-return valve (27) is a hose member (28) which is threaded into or onto said discharge pipe (9) and which has a closed outer end (29), the outer end (29) of the hose member (28) can be opened when substance (2) is pressing against said outer end, and the outer end (29) of the hose member (28) automatically returns to closed shape when the pressure of substance (2) against it ceases.

14. Dispensing device according to any claim 1, wherein the amount of substance (2) which is dispensed or discharged by means of the pump means (4) can be altered by replacing a piston means (13) which is provided to effect the pump means (4) for discharge of the substance (2), with another piston means (13) having another length and/or diameter.

15. Dispensing device according to claim 1, wherein the dispensing device (1) comprises or consists of the following four members which for separate cleaning are disconnectable from each other and then reconnectable, namely:

a lower and an upper member (7, 8), forming part of a dispensing or discharge housing (3) and disconnectable from each other, a pump means (4) with valve bodies (21, 25) for first and second non-return valves (20, 24), said pump means (4) being located between said lower and upper members (7, 8) and disconnectable therefrom, and a piston means (13) for effecting the pump means (4), said piston means (13) being releasable mounted on said upper member (8).

16. Dispensing device according to claim 1, wherein the dispensing device (1) is connected to a container (5) with substance (2) through a hose (6) and that the pump means (4) is provided to suck substance (2) from the container (5) through the hose (6) into the suction chamber (30).

17. Dispensing device according to claim 16, wherein the container (5) is a flexible container which is designed to collapse when substance (2) is sucked out of said container (5).

18. Dispensing device according to claim 1, wherein said substance (2) is mustard, ketchup, mayonnaise, dressing or cooking oil which shall be dispensed or discharged onto one or more locations.

19. Dispensing device for dispensing or discharging a liquid or viscous substance (2), wherein:

at least one pump means (4) is provided to perform pump motions for sucking said substance (2) into the dispensing device (1) and dispense or discharge it therefrom, the pump means (4) is provided to divide inner parts of the dispensing device (1) into at least one suction chamber (30) and at least one dispensing or discharge chamber (31) which are interconnected through at least one transfer chamber (32), the pump means (4) is provided in a dispensing or discharge housing (3) which defines the suction chamber (30), the transfer chamber (32) and the discharge chamber (31) and which comprises a lower and an upper member (7, 8), the lower and upper members (7, 8) can be interconnected and disconnected, parts of a flange (17) of the pump means (4) are situated between the lower and upper members (7, 8) when these members are interconnected, such that said parts of the flange (17) define sealing means between the lower and upper members (7, 8) when said members are interconnected, the pump means (4) can be released from the discharge housing (3) by disconnection of the lower and upper members (7, 8), the pump means (4), during a first pump motion in one direction (A), is provided to suck substance (2) into the suction chamber (30) and simultaneously dispense or discharge substance (2) from the discharge chamber (31), and the pump means (4), during a second pump motion in the opposite direction (D) relative to the first pump motion, is provided to feed substance (2) from the suction chamber (30) and through the transfer chamber (32) into the discharge chamber (31).

20. Dispensing device according to claim 19, wherein the lower and upper members (7, 8) include portions which define a bayonet mount or coupling (44) permitting interconnection and disconnection of said portions, preferably by rotating one of said members (7, 8) relative to the other member (7, 8).

21. Dispensing device for dispensing or discharging a liquid or viscous substance (2), wherein:

it comprises a dispensing or discharge housing (3) having a lower and an upper member (7, 8) which are interconnectable, the lower member (7) is rotatable relative to the upper member (8) about an imaginary geometric centre line (CL), the lower member (7) has a dispensing or discharge pipe (9) through which substance (2) can be dispensed or discharged from the discharge housing (3), the discharge pipe (9) is eccentrically located relative to the centre line (CL), the discharge pipe (9) can be set in different rotary positions relative to the centre line (CL) by rotating the lower member (7) relative to the upper member (8), at least one pump means (4) is provided to perform pump motions for sucking said substance (2) into the dispensing device (1) and dispense or discharge it therefrom, the pump means (4) is provided to divide inner parts of the dispensing device (1) into at least one suction chamber (30) and at least one dispensing or discharge chamber (31) which are interconnected through at least one transfer chamber (32), the pump means (4), during a first pump motion in one direction (A), is provided to suck substance (2) into the suction chamber (30) and simultaneously dispense or discharge substance (2) from the discharge chamber (31), and the pump means (4), during a second pump motion in the opposite direction (D) relative to the first pump motion, is provided to feed substance (2) from the suction chamber (30) and through the transfer chamber (32) into the discharge chamber (31).

* * * * *